US005292076A

United States Patent [19]

Oliver Pujol

[11] Patent Number: 5,292,076

[45] **Date of Patent: * Mar. 8, 1994**

[54] APPARATUS FOR COMMINUTING, CRUSHING AND DISAGGLOMERATION OF SOLIDS DISPERSED IN LIQUIDS

[75] Inventor: Carlos Oliver Pujol, Badalona, Spain

[73] Assignee: Oliver Y. Batlle, S.A., Badalona, Spain

[ * ] Notice: The portion of the term of this patent subsequent to May 19, 2009 has been disclaimed.

[21] Appl. No.: 891,650

[22] Filed: May 29, 1992

[30] Foreign Application Priority Data

Jun. 27, 1991 [ES] Spain ..... 9101517

[51] Int. Cl.[5] ..... B02C 17/16

[52] U.S. Cl. ..... 241/69; 241/171; 209/285

[58] Field of Search ..... 241/171, 69; 209/285, 209/300, 675

[56] References Cited

U.S. PATENT DOCUMENTS

| | | | |
|---|---|---|---|
| 4,620,673 | 11/1986 | Canepa et al. | 241/69 |
| 4,651,935 | 3/1987 | Samosky et al. | 242/65 |
| 4,709,863 | 12/1987 | Szkaradek et al. | 241/69 |
| 4,824,033 | 4/1989 | Buehler | 241/66 |
| 5,051,167 | 9/1991 | Höglund | 209/270 |
| 5,114,080 | 5/1992 | Pujol | 241/69 |

*Primary Examiner*—Mark Rosenbaum
*Assistant Examiner*—John M. Husar
*Attorney, Agent, or Firm*—Lackenbach Siegel Marzullo Aronson & Greenspan

[57] ABSTRACT

Grinding body separator in mills for comminuting and crushing deagglomerating solids, predispersed in liquids, which comprises circular rings provided with cross bores. The number of the bores decreases as a function of a decrease in diameter of the rings. The bores are equidistantly distributed on the rings. The diameter or the bores also decrease as a function of a decrease in diameter of the rings.

3 Claims, 4 Drawing Sheets

APPARATUS FOR COMMINUTING, CRUSHING AND DISAGGLOMERATION OF SOLIDS DISPERSED IN LIQUIDS

RELATED PATENT APPLICATION(S)

The petitioning entity of the present invention has developed improvements in the object of his U.S. patent application Ser. No. 718,350, U.S. Pat. No. 5,114,080 (corresponding to Spanish Patent No. 9002767) having as an object a relative separator of grinding bodies, in mills for communicating and crushing and deagglomerating solids, predispersed in liquids, wherein said improvements have been obtained and are the result of experience in this industrial field and, in particular, of the corresponding test and analysis applied in practice and execution of the separator.

BACKGROUND OF THE INVENTION

The referenced U.S. Main Patent teaches the already known mills described and, in particular, the filters or separators provided in said mills which retain the grinding bodies in the interior of the grinding chamber, but allow the exclusive passage of the already ground product. It is pointed out that the separators of screen or sieve type in general do not permit a very fine adjustment with the microballs and produce cloggings and obstructions, being and are moreover relatively complex and delicate to cleaning. This results in relatively high manual labor times and, in case of wear, in replacement costs. The repair for its utilization is economically not justified. The separators is the spilt or divided type imply a certain wear by having one part movable with respect to the other, thereby presenting a relatively complex disassembly and assembly, because the axle and other parts of the mill have to be disassembled for its cleaning, inspection, or replacement.

The type of mill for comminuting and crushing and deagglomerating solids, predispersed in liquids, to which is applied the separator, comprises a frame in which a fixed body or stator is disposed. In the interior of a jacket for cooling and for heating, respectively, of the product being treated, there is disposed a rotating body or rotor fixedly mounted to a shaft, disposed along the longitudinal axis of the mill and mounted on or projecting over a corresponding support and bearing means, disposed next to the frame of the mill. Said shaft exhibits inner conduits for cooling and heating means, respectively, of the rotor, and is caused to rotate by drive means with corresponding transmission and speed variations means, disposed next to the frame. The grinding chamber is delimited between said stator and said rotor. Grinding bodies are enclosed in said chamber where the grinding bodies are initially introduced into said chamber through a closable inlet of the stator. A likewise closable outlet is disposed in the lower part of the stator for the discharge. The grinding chamber is traversed by the product being treated—while the rotor rotates—based on impulse drive means of the cited product. Said means are moved by drive means and by transmission and speed variation means. The stator exhibits an inlet for the product to be treated, which is connected to the outlet of the impulse drive means and to an output of the already ground product. Separator means are disposed in said outlet area that prevent the exiting of the grinding bodies, but allow the passage of the ground product. Sealing means are disposed between the stator and the shaft to prevent the exiting of the product that circulates continuously and forcefully through the grinding chamber.

Said separator is characterized in that it is provided with a stepped support, which is preferably hollow and exhibits an ideal geometrical enveloping shape of a truncated cone. The steps of the support are formed by a series of circular superposed rings along parallel planes and perpendicular to the longitudinal axis of the separator. The series of rings exhibits a decreasing diameter from the larger basis of the support to its free end. Said series of rings is alternated with another series of short circular superposed cylinders. The centers of said short cylinders are disposed in said longitudinal axis of the separator and the diameters of said short cylinders are also decreasing as a function of the respective diameters of said rings. The larger base of the support comprises a flange and sealing means for its assembly in the corresponding mill in the outlet area of the already ground product. A series of circular rings is provided and exhibits a decreasing diameter from the larger base of the support to its free end. Each one of said rings is formed by an inner ring part and an outer ring part, both of which exhibit a quadrangular cross-section and are interconnected by bridges that delimit corresponding bores or cross-passages. Each ring is fitted in a respective step. The inner diameter of the inner ring corresponds to the outer diameter of the circular cylinder of the step in which it is mounted. The outer diameter of the outer ring part of each one of the rings following a larger ring, coincides with the inner diameter of the outer ring part of the ring on which it is juxtaposed. The thickness—measured in direction o the longitudinal axis of the separator—of the inner ring part of a ring is a little larger than the thickness of the outer ring part. A separation between each pair of juxtaposed rings—in the axial direction—is smaller than the smallest of the thicknesses or diameters of the grinding bodies to be retained in the grinding chamber. The outer ring part of each one of the rings, following a larger ring, delimits a space, with respect to the inner ring part of the ring on which it is juxtaposed, that is larger than the cited separation between each pair of rings. Preferably, there is detachably mounted on the larger base of the support a first circular ring part of quadrangular cross-section and of a larger outer diameter than the diameter of the larger ring o the series of rings. Said inner diameter coincides with the outer diameter of the outer ring part of the larger ring. There is further disposed, coplanarly or coaxially, a second circular ring part similar to the first one but smaller and practically equal to the inner ring part of the larger ring which is juxtaposed to it. The thickness of said second ring part—in axial direction—is a little greater than the outer ring part of the cited larger ring. A separation—in axial direction—between both is smaller than the smallest of the thicknesses or diameters of the grinding bodies. A conduit channel for the passage of the ground product towards the outlet of the mill through at least a longitudinal bore, disposed in the flange of the support, is delimited between said first and second circular rings. The unit formed by the series of rings and the second ring part is retained and fixed by a disk applied against the smaller ring and detachably fastened onto the smaller base of the stepped support of the separator. The outer diameter of said disk is equal to the inner diameter of the outer ring part of the smaller ring. Between the peripheral edge of this disk and the end facing the cited outer ring part of the smaller ring, there is delimited a separation equal to the separation between each pair of juxtaposed rings.

SUMMARY OF THE INVENTION

The separator, object of said Main U.S. Patent, eliminates said inconveniences of the conventional mills and provides, among others, the advantages of permitting a fine adjusting by means of microballs or the like, an easy cleaning, a simple assembly and disassembly, a facilitated reuse or application following mechanical adjustments, a lesser time requirement for processing the products to be ground, a greater efficiency, and smaller space requirements. Furthermore, it provides a finished product which is finer and more uniform and of a greater homogeneity in the distribution and size of the solids, dispersed in corresponding liquids once the product is treated and has passed through the separator in question. Futheremore, the probability of possible obstructions and jammings by the already ground product in its passage through the separator are diminished.

The improvements which are the object of the present invention are characterized in that the circular rings, mounted in the respective steps of the supports and exhibiting decreasing diameters from the larger base to its free end, exhibit cross bores. The number of the bores also decreases as function of a decrease in the diameter of said rings. Preferably, said bores are distributed equidistantly in each ring.

Furthermore, said improvements are characterized in that facultatively the cited bores of the circular rings exhibit a diameter that decrease as a function of a decrease in the diameter of said rings.

The improvements which are the object of the present invention eliminate the inconveniences and provide advantages, with respect to the known art, specified in the U.S. Patent and, moreover, provide the following advantages, among others, both with respect to the separator, which is the object of the U.S. Main Patent, as well as with respect to the separators of the mills already known in the art: The gradual increase of the flow of product that is entered into and transverses the separator at a uniform circulation, and the accommodation of relatively small volumes of flow without producing inconvenient accumulations of product in the interior of the separator.

The improvements of the separator offer the advantages that have been described above, in addition to others that will become readily apparent from the exemplified embodiment of said separator provided with such improvements, that are described in more detail in the following. In order to facilitate the understanding of the characteristics described above, a more detailed description is given with reference to the drawings, which is given as an exemplified embodiment and which is not limited to the extent of the present invention, but which is given as a practical example of same.

BRIEF DESCRIPTION OF THE DRAWINGS

In the drawings, the FIGS. 1A and 1B show a longitudinal vertical sectional view of the mill provided with the separator; the FIG. 2 represents a plan view of a ring integral to the separator; and the FIG. 3 corresponds to a section along III—III of FIG. 2.

DESCRIPTION OF THE PREFERRED EMBODIMENTS

Figure 1A:
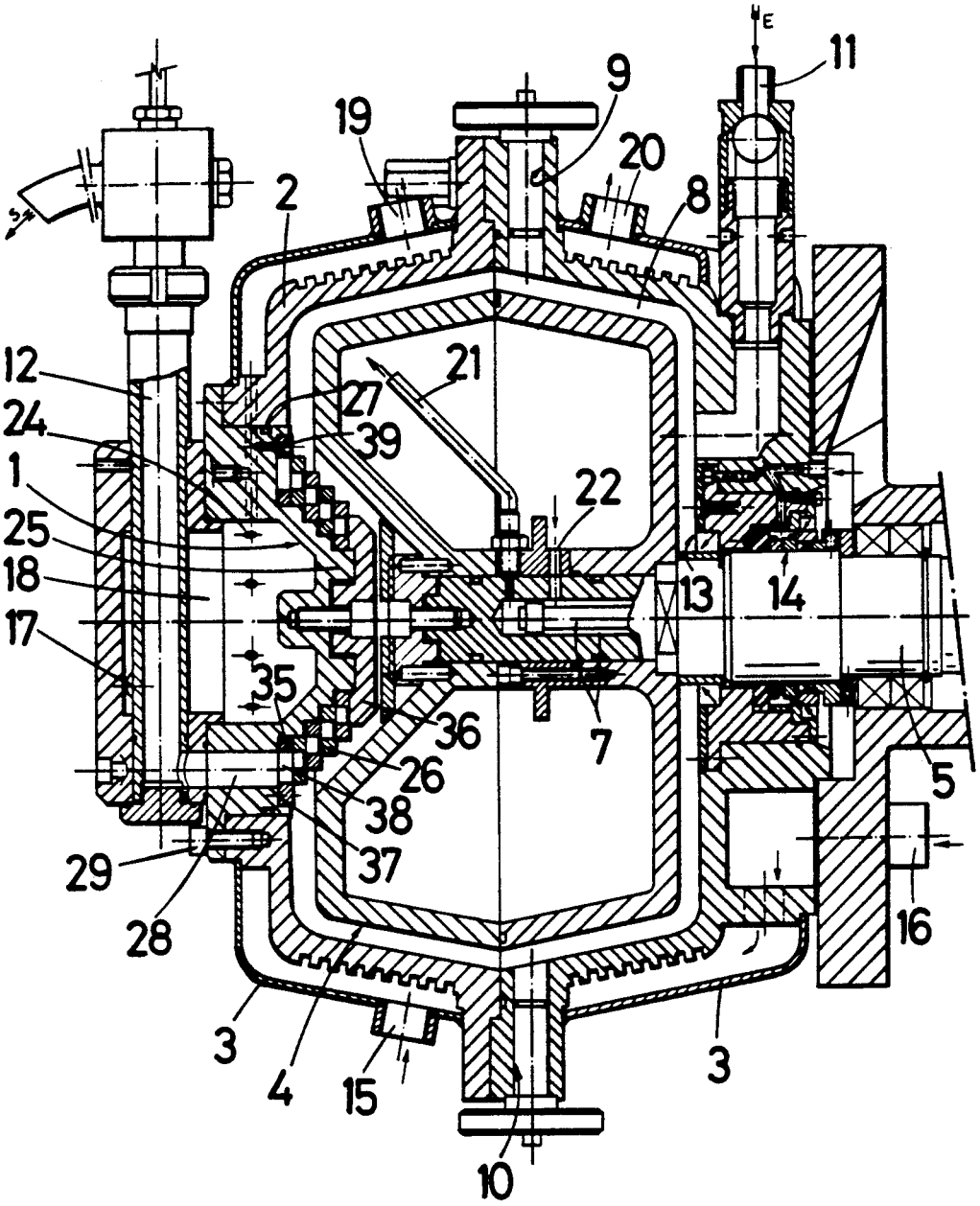
Figure 1B:
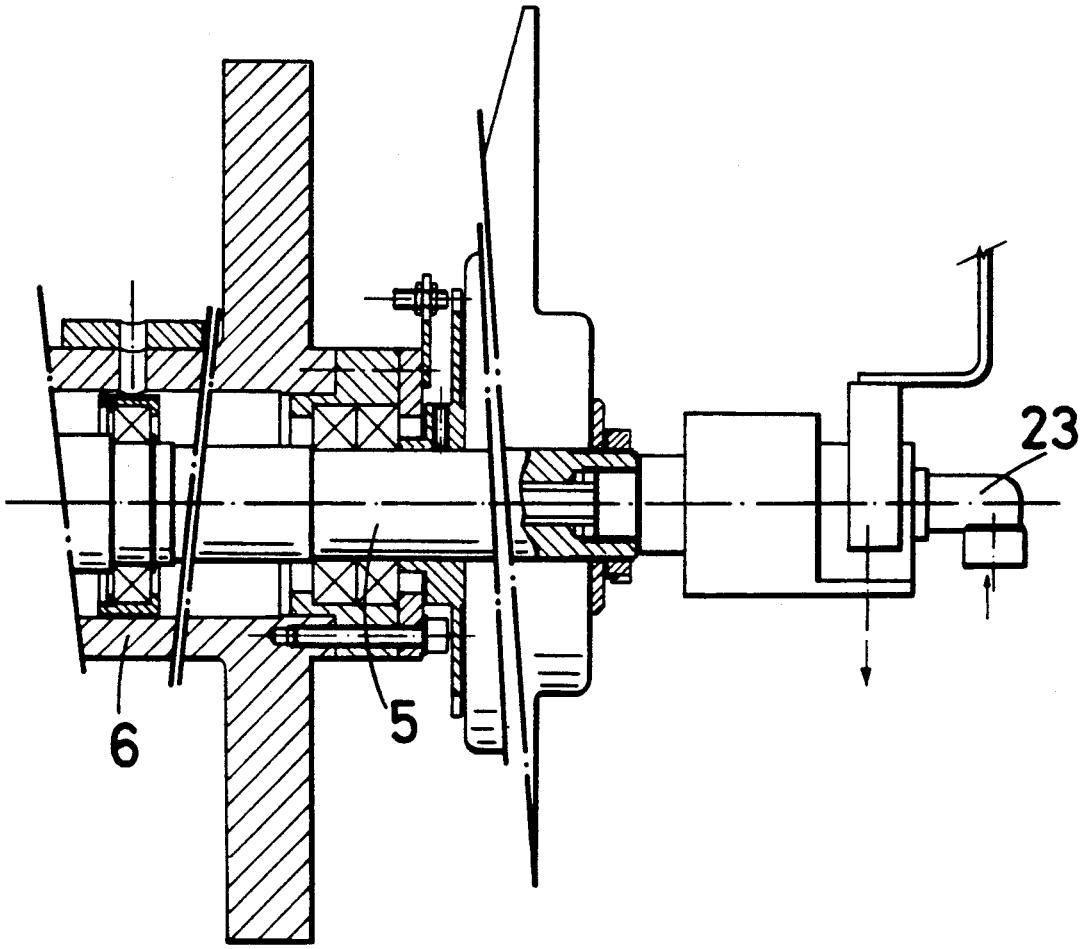

According to what is shown in the drawings, it comes out that the separator (1)—FIGS. 1A and 1B—of grinding bodies is applied to mills for comminuting and crushingl and deagglomeration solids predispersed in liquids, as illustrated in the cited figures. The separator, as described in this example, could be used in any other mill of the type that comprises a frame (not shown), in which there is disposed a stator (2), and a jacket for cooling and heating, respectively, of the product being treated. In the interior of the stator, a rotor (4) is fixed to a shaft (5), disposed along to the longitudinal axis of the mill and mounted on and projecting over in corresponding support and bearing means (6), connected to the frame of the mill. Said shaft is provided with inner conduits (7) for cooling and heating means of the rotor.

The shaft (5) is rotated by drive means and by conventional corresponding transmission and speed variation means (not shown) attached to the frame. The grinding chamber (8) is delimited between said stator and rotor. The grinding bodies are enclosed in said chamber, where the grinding bodies are initially introduced into said chamber through the inlet (9) of the stator and which can be closed. In the lower part of the stator there is disposed an outlet (10), also closable to said grinding bodies. The grinding chamber (8) is traversed by the product being treated—while the rotor rotates—based on conventional impulses drive means (not shown) of the cited product. The latter are moved by drive means and by also conventional transmission and variation speed means (not shown). The stator (2) exhibits an inlet part (11) for the product to be treated, connected to the output of the impulse drive of the same, and an output (12) of the already ground product. The separator (1) is disposed in and said outlet area prevents the exiting of the grinding bodies, but allows the passage of the ground product. Finally sealing means are disposed between the stator (2) and the shaft (5) such as the connection coupling (13) and (14), to prevent the escape of the product that circulates continuously and forcefully through the grinding chamber (8).

The jacket (3), that could be comprised of two parts, as in the illustrated example, will exhibit cooling or heating inlet conduit parts (15), (16) and (17)—of this last there can be seen part of its access nozzle to the cooling chamber (18) of the outlet pipe (12) of the already ground product—and outlet conduit parts (19) and (20). All these conduit parts will be connected to the corresponding cooling or heating networks. Likewise, the rotor (4) is cooled by pipes such as the pipe (21), that shoot the coolant and heating liquid, respectively, into the interior of the rotor and said liquid returns through conduits such as the conduit (22). Said pipes and conduits are connected to the respective inner conduction pipes (7) of the shaft (5). Said inner conduction pipes discharge to the outside via interlocking rotation device (23) of the shaft (5) which is connected with the corresponding cooling or heating network. In this example there can be seen bores such as the bore (24), which connects the chamber (18) and/or the cooling chambers delimited between the jackets (3) and the body of the stator (2).

The grinding chamber (8) is traversed by the product being treated—while the rotor rotates by the driving action of some conventional impulse drive means (not shown) of the cited product said means are moved by transmission and speed variation means (nor represented) of the cited product, which are moved by transmission and speed variation, also conventional (not shown). According to another embodiment, the product could come from the elevated storage, which is disposed at a greater height than the mill, or from a feeding network of same.

Figure 2:
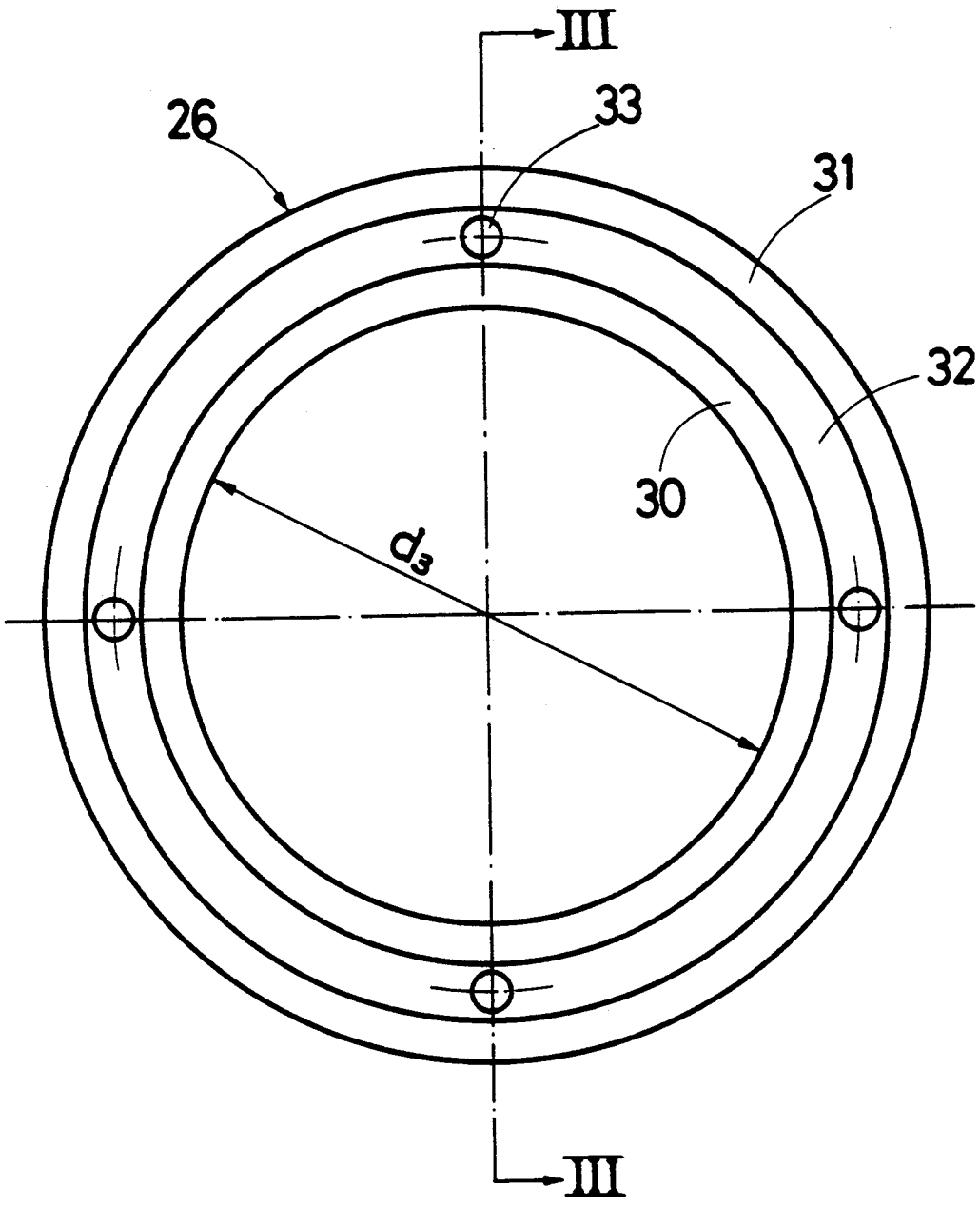
Figure 3:
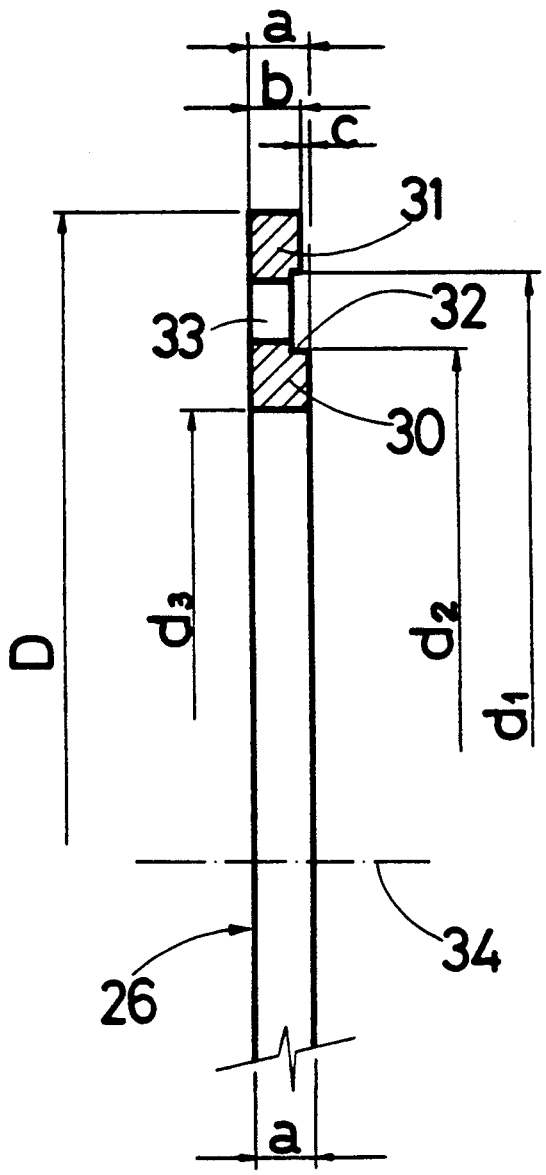

The separator (1) includes a support (25) (FIG. 1A) and a series of rings such as the ring (26) (FIGS. 1A, 2 and 3). The series of rings can be comprised of a variable number of rings and comprises in the example four rings. The support (25) is circular and stepped and preferably hollow. The ideal geometrical shape of the casing of the support is that of truncated cone and said steps are formed by a series of circular and superposed rings along parallel planes, perpendicular to the longitudinal axis of the separator and of decreasing diameter from the larger base of the support to its free end or smaller base. Said series of circular rings are disposed alternatingly with another series of short circular superposed cylinders, which centers are disposed in said longitudinal axis and which diameters are also decreasing in coordination with the respective diameters of the cited rings.

The larger base of the support exhibits a flange and sealing means for its assembly in the corresponding mill, such as the seal (27 ) (FIG. 1A), which is disposed in a circular race of the support, wherein said assembly is performed in the outlet area of the already ground product. Said larger base further exhibits the longitudinal passage (28) that discharges into the outlet (12) of the already ground product. The stepped support (25) is fastened to the front part of the stator (2) by means of screws (29). Said screws traverse bores provided in the flange, in such a way that said flange remains at the outside of the mill, while the rest of the support and its rings (26) remain toward the side of the grinding chamber (8), as illustrated in FIG. 1A.

The separator is completed with the series of circular rings (26), where the diameter of the rings decreases from the larger base of the support (25) towards the free end or smaller base of the latter. Each one of said rings comprises by an inner part (30) and an outer part (31)—FIGS. 2 and 3—, both of which exhibit a gradrangular cross-section and are interconnected by an intermediate recessed part (32). Cross bores (33)are disposed in said recessed part. The number of bores decreases as the diameter of said rings decreases. The illustrated ring exhibits four such cross bores. However, the number of bores will be variable not only for one and the same ring, but also for the rings juxtaposed preceding and/or following to same as a function of flow or volume of flow of the product that has to traverse each ring of separator.

The example illustrates an equidistant distribution of the bores in the ring however, such equidistant distribution is not required. The gradual increase of the flow or volume of flow of the product, entering and traversing the separator, i.e. to each one of the rings forming the separator is carried out without any difficulty, and allows a uniform circulation of the product, while preventing an inconvenient accumulation of same in the interior of the separator.

The outer diameter (D) of the outer part (31), of each one of the rings following the larger of them, coincides with the inner diameter (d1) of the corresponding outer part (31) of the ring on which ring there is juxtaposed, the thickness (a)—measured in the direction of the longitudinal axis (34) of the separator—of the inner part (30) of a ring, slightly larger than the thickness (b) of its outer part (31), thereby determining a separation (c) between each pair of juxtaposed rings—in the direction of the transverse axis coincident of the rings (34) and with the axis of the support which separation (c) is smaller than the thickness or diameters of the grinding bodies to be retained in the grinding chamber (8). It is pointed out that the separation (c) between each pair of rings, juxtaposed in the described way, coincides exactly with the difference between the thicknesses (a) and (b) of a same ring (FIG. 3), i.e. as seen in the juxtaposed of the rings in the FIG. 1A.

The outer part (31) of each one of the rings following a larger ring delimits a space with respect to the inner part (30) of the ring on which it is juxtaposed, which is greater than the cited separation (c) between each pair of rings, i.e. the inner diameter (d1) of the outer part (31) of the smaller-diameter ring, that is juxtaposed to the following ring of larger diameter (see FIG. 1A), is larger than the outer diameter (d2) of the inner part of said larger-diameter ring, establishing or delimiting between both rings and in this part of the same a circular separation that is greater than the likewise circular cited separation (c).

According to another embodiment, the cross bores (33) of the rings of the separator can exhibit a decreased diameter as a function of a decreased diameter of said rings.

The assembly unit composed of the series of rings (26) and possibly an additional ring (35) is retained and fixed by a disk (36). Said disk is applied against the smaller ring and is fastened in a detachable manner (for example, through a central screw), to the smaller base of the stepped support of the separator (1). The outer diameter of said disk is equal to the inner diameter (d1) of the outer part (31) of the cited smaller ring (36), while a separation equal to the separation (c) existing between each pair of juxtaposed rings is delimited between the peripheral edge of this disk (36) and the end facing the cited outer part of the smaller ring.

The section of the retention passages of the grinding bodies, determined by the separations between the juxtaposed rings and as described above, is smaller than the section of the rest of the inner conduit passages. Therefore, the probability of possible obstructions or jammings of the ground product is diminished in this part of the separator.

According to a preferred embodiment, an additional second circular ring (37) (FIG. 1A) is detachably fastened on the larger base of the stepped support. Said additional ring exhibits a quadrangular cross-section and has a larger outer diameter than the diameter (D) of the larger ring (26) of the series of rings. The inner diameter of the cited second ring coincides with the outer diameter (D) of the outer part (31) of said larger ring. The ring (37) is detachably fastened to the support (25) with screws (39).

The additional ring (35) is practically equal to the inner part (30) of the larger ring that is juxtaposed to it. The thickness of said ring (35)—in axial direction—is a little larger than the thickness of the outer part (31) of the cited larger ring, determining between both a separation—in axial direction—which is smaller than the smallest of the thickness or diameters of the grinding bodies.

A circular channel (38) for the passage of the already ground product towards the mill outlet is delimited between both rings (35) and (37). Said conduit channel 38 is in connection with the bore or longitudinal passage (28) that traverses the flange of the support (25). It is pointed out that more than one such longitudinal bore (28) can be present depending on the requirements for the operation of the mill.

It should be made certain that in the realization of the present invention various modifications and structural changes of constructive detail may be made without departing in any way from the spirit of the present invention and the following claims.

I claim:

1. In a mill having an outlet and a grinding body separator, comprising a stator and rotor with a grinding chamber therebetween, and having a longitudinal axis and a truncated cone-shaped stepped support for grinding and breaking up solids predisposed in a liquid, the improvement comprising a separator 1 having a fixed base support 25 in the form of a truncated stepped cone fixed to the stator and supporting a plurality of rings 26 positioned on a series of circular steps formed on said base support 25; said circular steps and said rings being parallel to each other and perpendicular to the longitudinal axis of said separator; and said rings being of decreasing diameter from the base support to its cone end; each of said rings having a plurality of through bores wherein the number of said through bores decreasing as a function of a decrease in the diameter of said rings, and wherein said through bores are equidistantly spaced about said rings and enable the flow of said ground solids to enter and traverse said rings of said separator and to exit therefrom uniformly and smoothly and without any accumulation of solids in the grinding chamber of the mill.

2. The improvement according to claim 1, wherein the diameter of said through bores in said rings decreasing in size as a function of a decrease in the diameter of said rings.

3. The improvement according to claim 1, wherein additional circular rings 35 and 37 from a circular conduit channel therebetween for the passage of said ground solids to the outlet of said mill from said through bores of said plurality of rings via passage means 28 in said base support 25 communicating with the mill's outlet.

* * * * *

UNITED STATES PATENT AND TRADEMARK OFFICE

CERTIFICATE OF CORRECTION

PATENT NO. : 5,292,076

DATED : March 8, 1994

INVENTOR(S) : Oliver Pujol

It is certified that error appears in the above-identified patent and that said Letters Patent is hereby corrected as shown below:

Title page, item [30] Foreign application priority data to read as follows:

-- June 27, 1991 [ES] Spain .....9101516 --

Signed and Sealed this

Thirtieth Day of August, 1994

Bruce Lehman

*Attest:*

BRUCE LEHMAN

*Attesting Officer*

*Commissioner of Patents and Trademarks*